US008220228B2

(12) United States Patent
Itoh

(10) Patent No.: US 8,220,228 B2
(45) Date of Patent: Jul. 17, 2012

(54) CAP REMOVAL APPARATUS AND CAP REMOVAL METHOD FOR VACUUM BLOOD COLLECTION TUBES

(75) Inventor: Teruaki Itoh, Kumamoto (JP)

(73) Assignee: IDS Co., Ltd., Kumamoto-shi, Kumamoto (JP)

( * ) Notice: Subject to any disclaimer, the term of this patent is extended or adjusted under 35 U.S.C. 154(b) by 333 days.

(21) Appl. No.: 12/149,745

(22) Filed: May 7, 2008

(65) Prior Publication Data

US 2008/0276758 A1 Nov. 13, 2008

(30) Foreign Application Priority Data

May 11, 2007 (JP) ..... 2007-127086

(51) Int. Cl.
*B65B 31/00* (2006.01)
*B65B 43/38* (2006.01)

(52) U.S. Cl. ..... 53/510; 53/381.4

(58) Field of Classification Search ..... 53/432, 53/471, 485, 510, 167, 381.4, 393
See application file for complete search history.

(56) References Cited

U.S. PATENT DOCUMENTS 4,217,798 A * 8/1980 McCarthy et al. ..... 81/3.2
4,522,089 A * 6/1985 Alvi ..... 81/3.42
5,380,486 A * 1/1995 Anami ..... 422/63
5,784,862 A * 7/1998 Germano ..... 53/512
7,121,402 B2 * 10/2006 Van Heerden et al. ..... 206/222

FOREIGN PATENT DOCUMENTS

JP 2005-271991 10/2005

* cited by examiner

*Primary Examiner* — Rinaldi I. Rada
*Assistant Examiner* — John Paradiso
(74) *Attorney, Agent, or Firm* — Nixon & Vanderhye P.C.

(57) ABSTRACT

A cap removal apparatus for a vacuum blood collection tube is configured to remove a cap from the collection tube of which an opening is closed by the cap so that the tube is kept under vacuum inside. The cap removal apparatus comprises, a tube clamping mechanism which clamps the collection tube upright in a cap removal position, a chuck mechanism which is disposed in the cap removal position and chucks the cap of the collection tube, seal pressure reduction unit which is disposed in the a chuck mechanism and configured to seal a region around the opening including the cap and reduce the pressure of the sealed region to substantially the same level as the internal pressure of the collection tube when the cap is chucked, and a lift mechanism which raises the chuck mechanism from a cap chucking position, thereby removing the cap from the collection tube.

3 Claims, 3 Drawing Sheets

CAP REMOVAL APPARATUS AND CAP REMOVAL METHOD FOR VACUUM BLOOD COLLECTION TUBES

CROSS-REFERENCE TO RELATED APPLICATIONS

This application is based upon and claims the benefit of priority from prior Japanese Patent Application No. 2007-127086, filed May 11, 2007, the entire contents of which are incorporated herein by reference.

BACKGROUND OF THE INVENTION

1. Field of the Invention

The present invention relates to a cap removal apparatus and a cap removal method for vacuum blood collection tubes, configured to automatically remove caps from vacuum blood collection tubes that contain collected blood.

2. Description of the Related Art

A test tube that contains blood has its opening closed by a cap, such as a rubber cap. In a blood aliquoting/dispensing apparatus, for example, a large number of test tubes are supported one after another by test tube holders or the like and conveyed by a conveyor belt. When the test tube reaches a cap removal position in the course of conveyance, the conveyance of the test tube is temporarily stopped, and the cap on the test tube is automatically removed by a test tube cap removal apparatus. The uncapped test tube is conveyed to an aliquoting/dispensing position by the conveyor belt again, whereupon the blood in the test tube is aliquoted and dispensed by the aliquoting/dispensing apparatus.

In a test tube cap removal apparatus described in Jpn. Pat. Appln. KOKAI Publication No. 2005-271991, for example, a cap on a test tube held by a test tube clamping mechanism is chucked by a chuck mechanism. Thereafter, the chuck mechanism is raised by a lift mechanism so that the cap is removed from the test tube.

In the case of a vacuum blood collection tube formed of a decompressed test tube that contains blood, the atmospheric pressure outside the collection tube that is kept under vacuum inside rushes into the tube the moment the cap is removed. Accordingly, the surface level of the blood in the collection tube is depressed by the atmospheric pressure, so that the blood splashes out of the collection tube and adheres to peripheral devices or adjoining collection tubes, thereby causing contamination.

The present invention has been made in consideration of these circumstances, and its object is to provide a cap removal apparatus and a cap removal method for vacuum blood collection tubes, capable of easily preventing blood from splashing out of the collection tubes when the collection tubes are uncapped, thereby solving the problem of contamination.

BRIEF SUMMARY OF THE INVENTION

According to an aspect of the invention, a cap removal apparatus for a vacuum blood collection tube is configured to remove a cap from the collection tube of which an opening is closed by the cap so that the tube is kept under vacuum inside. The cap removal apparatus comprises, a tube clamping mechanism which clamps the collection tube upright in a cap removal position, a chuck mechanism which is disposed in the cap removal position and chucks the cap of the collection tube, seal pressure reduction means which is disposed in the chuck mechanism and configured to seal a region around the opening of the collection tube including the cap and reduce the pressure of the sealed region to substantially the same level as the internal pressure of the collection tube when the cap is chucked, and a lift mechanism which raises the chuck mechanism from a cap chucking position, thereby removing the cap from the collection tube.

According to another aspect of the invention, a cap removal method for a vacuum blood collection tube is configured to remove a cap from the collection tube of which an opening is closed by the cap so that the tube is kept under vacuum inside. The cap removal method comprising, a first process for clamping the collection tube upright in a cap removal position, a second process for chucking the cap of the clamped collection tube, a third process for sealing a region around the opening of the collection tube including the cap and reducing the pressure of the sealed region to substantially the same level as the internal pressure of the collection tube when the cap is chucked, and a fourth process for removing the cap from the collection tube.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will now be described with reference to the accompanying drawings.

Figure 1:
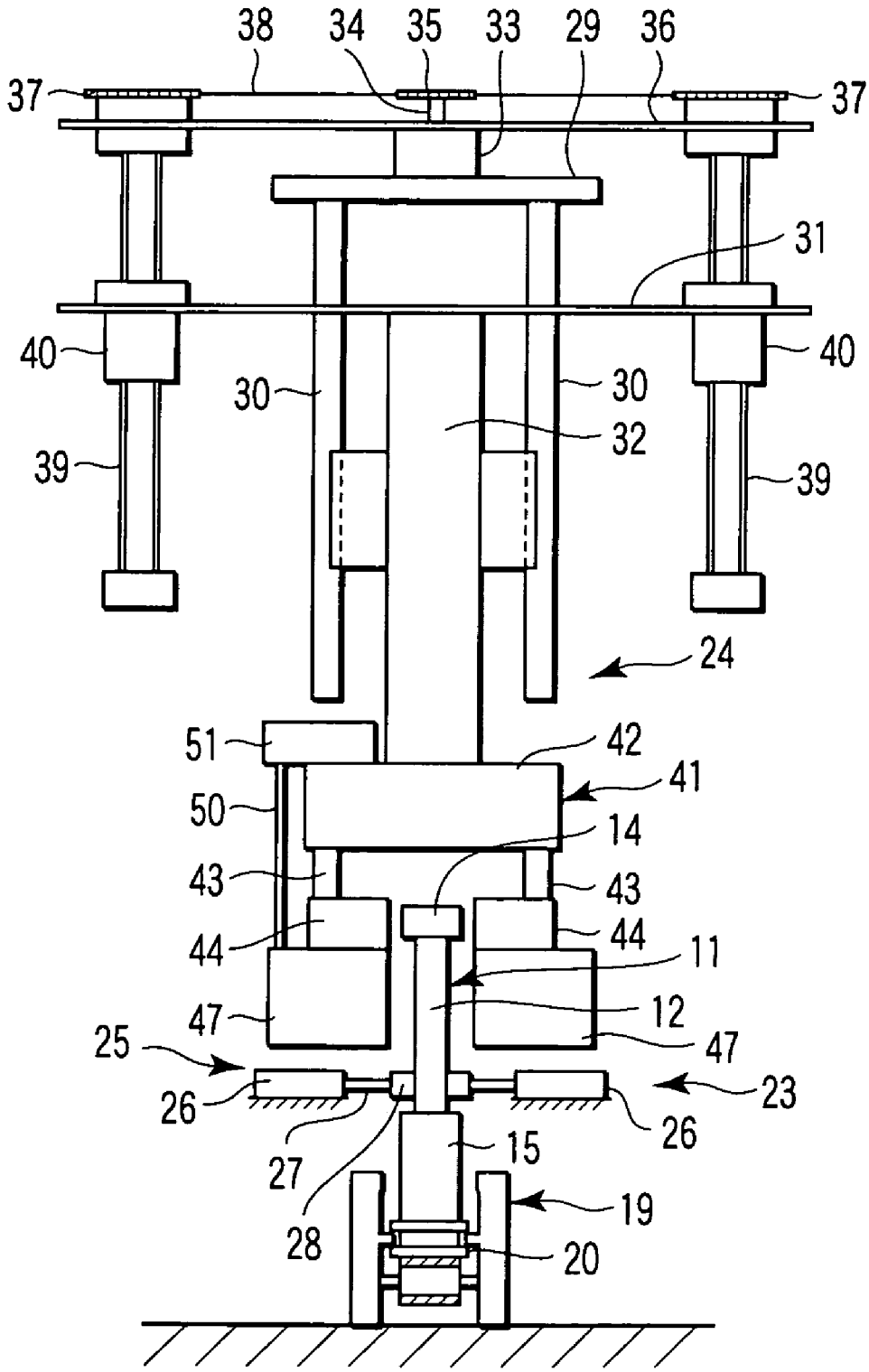
FIG. 1 is a front view of a cap removal apparatus for vacuum blood collection tubes according to a first embodiment of the invention.
Figure 2:
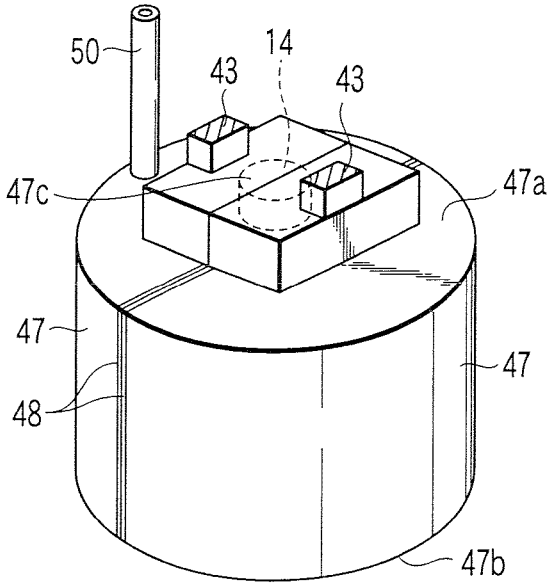
FIG. 2 is a perspective view of cover members of the same embodiment.
Figure 4:
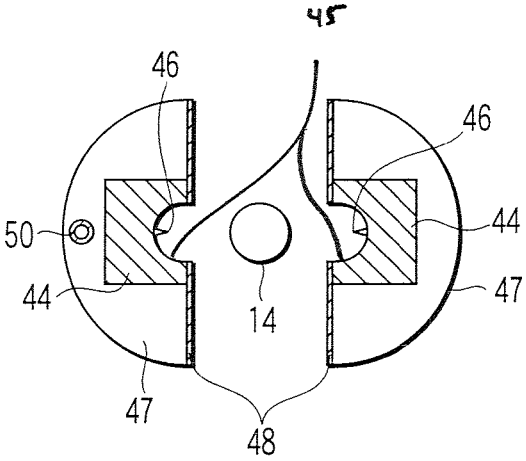
FIG. 4 is a sectional view of the cap removal apparatus of the embodiment taken along line A-A of FIG. 3A.
Figure 3A:
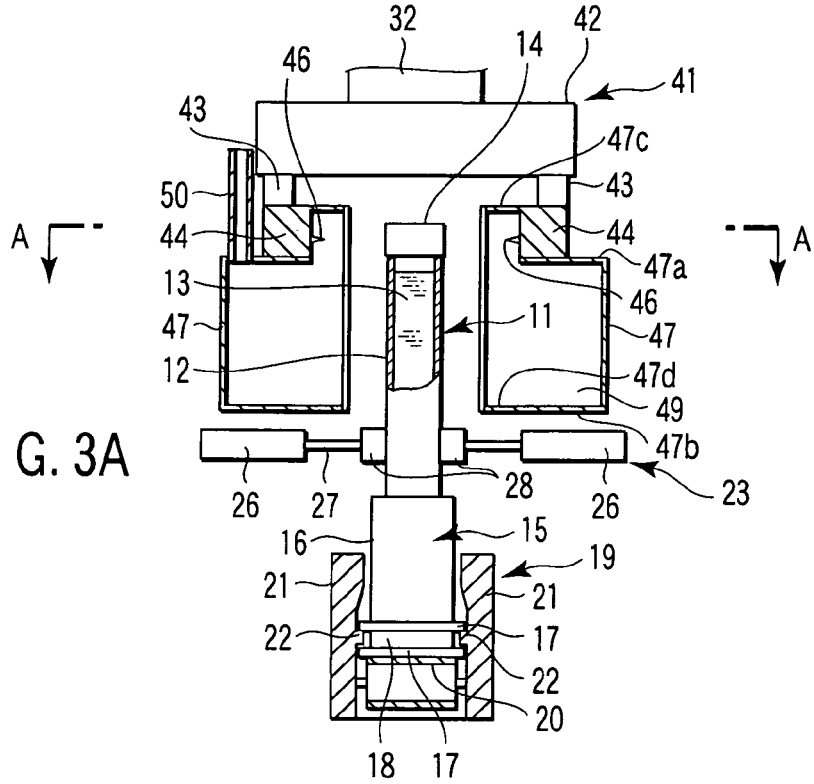
FIG. 3A is a longitudinal sectional front view showing principal parts of the cap removal apparatus of the same embodiment with its chuck members open.
Figure 3B:
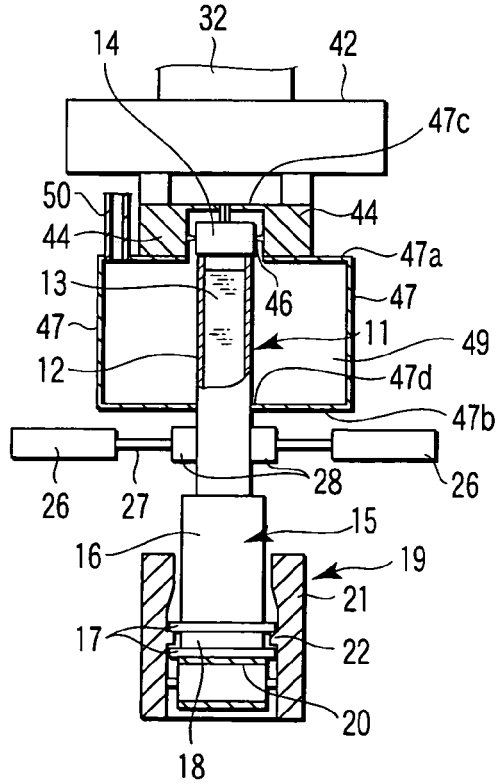
FIG. 3B is a longitudinal sectional front view showing the principal parts of the cap removal apparatus of the same embodiment with the chuck members closed.

FIG. 1 is a front view of a cap removal apparatus of a vacuum blood collection tube, FIG. 2 is a perspective view of cover members, FIGS. 3A and 3B are enlarged longitudinal sectional front views showing principal parts, and FIG. 4 is a sectional view taken along line A-A of FIG. 3. Number 11 denotes the vacuum blood collection tube, of which a plastic or glass tubular body 12 contains collected blood 13 therein. An opening of the tubular body 12 is closed by a cap 14 of rubber or synthetic resin so that the tubular body is kept under vacuum inside.

The vacuum blood collection tube 11 is inserted and held upright in a blood collection tube holder 15. The tube holder 15 is provided with a pair of flanges 17, upper and lower, at the lower end portion of a bottomed cylinder 16 so that an annular groove 18 is defined between the flanges 17. The tube holder 15 is configured to hold the vacuum blood collection tube 11 as it is conveyed on a blood collection tube transport path 19.

The tube transport path 19 is composed of an endless conveyor belt 20, a pair of guide rails 21, and guide ridges 22. The conveyor belt 20 has a top mounting surface on which the bottom surface of the tube holder 15 is placed. The guide rails 21 are set up individually on the opposite sides of the conveyor belt 20. The guide ridges 22 are arranged on opposite surfaces of the guide rails 21 and engage the annular groove 18 of the tube holder 15. As the conveyor belt 20 runs, the tube holders 15 that hold the collection tube 11 each are conveyed in a single file.

A cap removal position 23 in which the cap 14 is removed from the vacuum blood collection tube 11 is located in the middle of the tube transport path 19. A cap removal apparatus 24 for automatically removing the cap 14 from the tubular body 12 is disposed in the cap removal position 23.

The following is a description of the cap removal apparatus 24. The cap removal position 23 is provided with a tube clamping mechanism 25, which holds the vacuum blood collection tube 11 upright in the cap removal position. In the tube clamping mechanism 25, a pair of opposite air cylinders 26 are fixed horizontally above and on either side the tube transport path 19. Piston rods 27 of the air cylinders 26 are provided individually with dampers 28, which hold, from both sides, the tubular body 12 of the collection tube 11 that is supported by the tube holder 15. Each damper 28 is formed of, for example, a rubber member. Arcuate surfaces are formed individually on the respective clamping surfaces of the dampers 28 so as to spread along the outer peripheral surface of the tubular body 12. Thus, the tubular body 12 can be held by the dampers 28 so as not to move either circumferentially or axially.

A fixed frame 29 is disposed over the cap removal position 23. A pair of guide members 30 are vertically fixed to the fixed frame 29. The fixed frame 29 is provided with a movable frame 31 capable of up-and-down motion. The movable frame 31 is provided with a lift shaft 32 that ascends and descends guided by the guide members 30.

A reversible drive motor 33 is mounted on top of the fixed frame 29 with its rotating shaft 34 upward, and a driving sprocket 35 is fitted on the shaft 34. A support plate 36 that extends in the lateral direction of the drive motor 33 is fixed to the fixed frame 29. Driven sprockets 37 are rotatably mounted on the opposite end portions of the support plate 36. An endless chain 38 is passed around and between the driving sprocket 35 and the left- and right-hand driven sprockets 37, whereby the driven sprockets 37 are rotated in the same direction.

Each of the left- and right-hand driven sprockets 37 is provided with a screw rod 39, which extends downward and is rotatable integrally with the driven sprocket. Further, nut members 40 that mate individually with the left- and right-hand screw rods 39 are fixed to the movable frame 31. Accordingly, a rotary motion of each screw rod 39 is converted into a linear motion by each corresponding nut member 40. Thus, a lift mechanism is constructed such that the movable frame 31 ascends and descends with respect to the fixed frame 29.

A chuck mechanism 41 for chucking the cap 14 of the vacuum blood collection tube 11 is disposed at the lower end portion of the lift shaft 32 that is fixed to the movable frame 31. The chuck mechanism 41 is provided with, for example, a dual-axis air cylinder 42 for use as a drive mechanism, which is fixed to the lower end portion of the lift shaft 32 so as to lie horizontally. A pair of chuck members 44 are disposed individually on the opposite end portions of the air cylinder 42 with the aid of open-close members 43 that are simultaneously movable in a lateral (open-close) direction.

Arcuate surfaces 45 are formed individually on the respective chuck surfaces of the pair of chuck members 44 so as to spread along the outer peripheral surface of the cap 14. A piercing needle 46 that can be inserted into the cap 14 protrudes horizontally inward from each arcuate surface 45. Further, the chuck members 44 are provided individually with a pair of openable cover members 47 for use as seal pressure reduction means.

The cover members 47 are formed by halving a cylindrical body left and right, and blocking portions 47*a* and 47*b* are disposed on the upper and lower surfaces, respectively, of each cover member 47. The upper blocking portion 47*a* of each cover member 47 is fixed integrally with each corresponding chuck member 44, and a blocking portion 47*c* that covers the top of each arcuate surface 45 is disposed on top of the chuck member 44. Further, the blocking portion 47*b* is provided with a semicircular fitting portion 47*d* that engages the tubular body 12 of the vacuum blood collection tube 11. Seal members 48 such as rubber members are fitted on the respective opening edges of the cover member 47 and the blocking portions 47*a*, 47*b* and 47*c*. Thus, a space portion 49 as a sealing area that encloses each chuck member 44 is formed when the cover member 47 and the blocking portions 47*a*, 47*b* and 47*c* are closed.

The blocking portion 47*a* of each cover member 47 is provided with a through hole, which is connected to a vacuum pump 51 for use as a vacuum suction mechanism that is fixed to the dual-axis air cylinder 42 by a pipe 50. Thus, the space portion 49 that is defined by the cover member 47 can be decompressed by vacuum suction.

The following is a description of the operation of the cap removal apparatus constructed in this manner.

The opening of the vacuum blood collection tube 11 that contains the collected blood 13 is closed by the cap 14 so that the tube is kept under vacuum inside. The collection tube 11 is inserted and held in the blood collection tube holder 15 and conveyed in one direction by the blood collection tube transport path 19. When the cap removal position 23 is reached by the tube holder 15 that holds the collection tube 11 therein, it is detected by a sensor or the like, and the tube holder 15 is stopped by stop means. At the same time, the tube clamping mechanism 25 is actuated.

The pair of air cylinders 26 of the tube clamping mechanism 25 are simultaneously actuated to cause the piston rods 27 to project so that the tubular body 12 of the vacuum blood collection tube 11 that is supported by the tube holder 15 is held by the dampers 28 from both sides. Thus, the tubular body 12 is fixed so as not to move either circumferentially or axially.

Then, the drive motor 33 is driven to rotate the driving sprocket 35, and this rotation is transmitted to the driven sprockets 37 by the endless chain 38. When the screw rods 39 rotate as the left- and right-hand driven sprockets 37 rotate, the nut members 40 that mate individually with the screw rods 39 move downward. Accordingly, the movable frame 31 is guided by the guide members 30 to descend with respect to the fixed frame 29, whereupon the chuck mechanism 41 at the lower end portion of the lift shaft 32 descends.

The drive motor 33 stops when the pair of chuck members 44 of the chuck mechanism 41 in an open state reach positions where they face lateral portions of the cap 14 of the vacuum blood collection tube 11, individually. Then, the dual-axis air cylinder 42 of the chuck mechanism 41 is actuated so that the chuck members 44 are closed by the open-close members 43. Thus, the cap 14 is chucked by the chuck members 44, so that the piercing needles 46 are stuck into the sidewall of the cap 14. Since the chuck members 44 are provided individually with the cover members 47, regions over the respective arcuate surfaces 45 of the chuck members 44 are closed by the blocking portions 47*c*, and the tubular body 12 of the collection tube 11 is fitted with the fitting portions 47*d*. The seal members 48 seal the respective opening edges of the cover member 47 and the blocking portions 47*a*, 47*b* and 47*c*. Thus, the space portion 49 and the chuck members 44 enclose a surrounding area including the opening of the collection tube 11.

Since the vacuum pump 51 is always subjected to vacuum suction, the pressure inside each space portion 49 is reduced to substantially the same level as the internal pressure of the vacuum blood collection tube 11 when each cover member 47 is closed. If the drive motor 33 is driven reversely in this state, the screw rods 39 rotate reversely, whereupon the lift shaft 32 is raised by the nut members 40. The cover members 47 ascend together with the pair of chuck members 44, so that the fitting portions 47*d* ascend sliding on the outer peripheral surface of the tubular body 12.

Accordingly, the cap 14 that is chucked by the pair of chuck members 44 of the chuck mechanism 41 is disengaged from the tubular body 12 as the chuck members 44 ascend. Thus, the cap 14 is removed from the vacuum blood collection tube 11. When this is done, the pressure inside each space portion 49 is lowered, so that its difference from the internal pressure of the collection tube 11 is reduced. Therefore, the blood 13 in the collection tube 11 cannot be suddenly pressed by the atmospheric pressure, so that it can be prevented from splashing out of the collection tube and adhering to and contaminating peripheral devices or adjoining collection tubes.

According to the present invention, a region around the opening of the vacuum blood collection tube including the cap is sealed before the cap is removed from the collection tube, and the pressure of the sealed region is reduced so that its difference from the internal pressure of the collection tube can be reduced. Thus, the atmospheric pressure can be prevented from rushing into the vacuum blood collection tube and depressing the surface level of the blood in the collection tube the moment the cap is removed. In consequence, the blood can be prevented from splashing out of the collection tube and adhering to and contaminating the peripheral devices or adjoining collection tubes.

In the foregoing embodiment, moreover, the cap 14 is chucked by the pair of chuck members 44 of the chuck mechanism 41, and the chuck mechanism 41 is raised as it is for cap removal. Alternatively, however, the cap 14 may be rotated by the chuck members 44 as it is wrenched open.

The present invention is not limited directly to the embodiment described above, and its components may be embodied in modified forms without departing from the scope or spirit of the invention. Further, various inventions may be made by suitably combining a plurality of components described in connection with the foregoing embodiment. For example, some of the components according to the foregoing embodiment may be omitted. Furthermore, components according to different embodiments may be combined as required.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cap removal apparatus for a vacuum blood collection tube, configured to remove a cap from the collection tube of which an opening is closed by the cap so that the tube is kept under vacuum inside, the cap removal apparatus comprising:

a tube clamping mechanism which clamps the collection tube upright in a cap removal position;

a chuck mechanism which is disposed in the cap removal position and chucks the cap of the collection tube;

seal pressure reduction means which is disposed in the chuck mechanism and configured to seal and close a region around the opening of the collection tube including the cap and reduce the pressure of the sealed region to substantially the same level as the internal pressure of the collection tube when the cap is chucked;

a lift mechanism which raises the chuck mechanism from a cap chucking position, thereby removing the cap from the collection tube, wherein the chuck mechanism includes a pair of chuck members, and wherein the seal pressure reduction means is composed of at least a pair of cover members which open and close together with the chuck mechanism and enclose the chuck members and the region around the opening of the vacuum blood collection tube, the cover members being connected with a vacuum suction mechanism for reducing an inside pressure, wherein the pair of cover members are formed of a pair of containers which each have a substantially semicircular cross section and of which opening edges are opposed to each other, the respective opening edges of the containers being provided individually with seal members which closely contact each other to seal the periphery of the vacuum blood collection tube when the opening edges are closed; and blocking portions disposed on upper and lower surfaces of the cover members, the blocking portions including an upper blocking portion fixed to each chuck member, a top blocking portion that covers a top of each chuck member, and a bottom blocking portion including a semi-circular fitting portion that is engageable with the collection tube, wherein a space portion that encloses each chuck member is defined when the cover members and the blocking portion are closed, the upper blocking portion including a through hole in communication with said pressure reduction means, the pressure reduction means reducing a pressure in the space portion via the through hole, wherein the chuck members and the space portion enclose an area including the opening of the collection tube.

2. A cap removal apparatus for a vacuum blood collection tube according to claim 1, wherein the chuck mechanism includes a cylinder and piercing needles disposed on the chuck members and configured to be stuck into the cap, and wherein the pair of chuck members are driven by the cylinder to laterally chuck the cap.

3. A cap removal apparatus for a vacuum blood collection tube according to claim 1, wherein the cover members air tightly close the space portion in periphery of the opening of the collection tube.

* * * * *